US006436617B1

(12) United States Patent
Wang et al.

(10) Patent No.: US 6,436,617 B1
(45) Date of Patent: Aug. 20, 2002

(54) PROTECTIVE EPOXY OVERCOAT FOR IMAGING ELEMENTS

(75) Inventors: Yongcai Wang; Kevin M. O'Connor, both of Webster; Melvin M. Kestner, Hilton; James L. Bello, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/699,866

(22) Filed: Oct. 30, 2000

(51) Int. Cl.[7] ..... G03C 1/76; G03C 1/74; G03C 5/26; G03C 11/06; G03C 11/08

(52) U.S. Cl. ..... 430/350; 430/444; 430/463; 430/531; 430/533; 430/536; 430/961

(58) Field of Search ..... 430/350, 14, 531, 430/536, 537, 961, 444, 463, 533

(56) References Cited

U.S. PATENT DOCUMENTS 4,554,235 A * 11/1985 Adair et al. ..... 430/961
4,797,353 A * 1/1989 Yamada et al. ..... 430/961
5,853,926 A * 12/1998 Bohan et al. ..... 430/350
5,856,051 A * 1/1999 Yau et al. ..... 430/537
6,153,363 A * 11/2000 Nair et al. ..... 430/536
6,187,517 B1 * 2/2001 Whitesides et al. ..... 430/537
6,190,843 B1 * 2/2001 Yau et al. ..... 430/537
6,194,130 B1 * 2/2001 Nair et al. ..... 430/531
6,232,049 B1 * 5/2001 Nair et al. ..... 430/531

* cited by examiner

*Primary Examiner*—Richard L. Schilling
(74) *Attorney, Agent, or Firm*—Chris P. Konkol

(57) ABSTRACT

The present invention relates to photographic elements having a protective overcoat that resists fingerprints, common stains, and spills. The overcoat comprises an epoxy material, an acid polymer, a water-soluble hydrophilic binder and an associative thickener. In one embodiment, a photographic element includes a support, at least one silver halide emulsion layer superposed on the support and a processing-solution-permeable overcoat overlying the silver halide emulsion layer that becomes water-resistant in the final product without requiring lamination or fusing. The present invention is also directed to a method of making a print involving developing the photographic element.

14 Claims, No Drawings

PROTECTIVE EPOXY OVERCOAT FOR IMAGING ELEMENTS

FIELD OF THE INVENTION

The present invention relates to imaged elements having a protective overcoat that resists fingerprints, common stains, and spills. In particular, the invention is directed to a photographic element comprising an overcoat made from a water-dispersible epoxy-functional latex.

BACKGROUND OF THE INVENTION

Gelatin has been used extensively in a variety of imaging elements as the binder because of its many unique and advantageous properties. For example, its property of water swellability allows processing chemistry to be carried out to form silver halide-based photographic images, and its hydrophilic nature allows gelatin to function as an ink-receiver in ink-jet recording media. For a photographic element, an aqueous solution needs to penetrate the surface of the element to contact the silver halide and couplers necessary for dye mage formation. Therefore, water-soluble polymers or materials which have affinity for water are proven to be the binders of choice for photographic elements. However, while these materials are good for image development, they are not strong enough to resist mechanical damage such as scratching, tearing, and other types of deformation. Furthermore, the imaged elements, after image formation is complete, have very little resistance to fingerprints or to stains from food and drink spills. Imaging elements with exposed gelatin-containing materials, no matter if they are formed on transparent or reflective media, need to be handled with extreme care so as not to come into contact with aqueous solutions that may damage the images. Accidental spillage of common household solutions such as coffee, punch, or even plain water can damage imaged elements such as ink-jet, electrophotographic, or photographic prints.

There have been attempts over the years to provide protective layers for gelatin based photographic systems that will protect the images from damages by water or aqueous solutions. U.S. Pat. No. 2,173,480 describes a method of applying a colloidal suspension to moist film as the last step of photographic processing before drying. A number of patents describes methods of solvent coating a protective layer on the image after photographic processing is completed, for example, U.S. Pat. Nos. 2,259,009, 2,331,746, 2,798,004, 3,113,867, 3,190,197, 3,415,670 and 3,733,293. U.S. Pat. No. 5,376,434 describes a protective layer formed on a photographic print by coating and drying a latex on a gelatin-containing layer bearing an image. The latex is a resin having a glass transition temperature of from 30° C. to 70° C. A drawback for a solvent coating method is the health and environmental concern of those chemicals to the coating operator.

Alternatively lamination can be used to provide an imaged element with resistance to scratch, water, and stain resistance. Lamination typically involves placing a protective layer, coated on a suitable support, onto the image which is to be protected. The support for the protective coating may remain permanently adhered to the image or it may subsequently be peeled off leaving only the protective layer adhered to the image. Lamination has several disadvantages in that it brings about an added expense associated with coating an additional support. In addition, air pockets may be trapped during the laminating step, leading to image defects.

Protective coatings that need to be applied to an image after it is formed, several of which coatings were mentioned above, add a significant cost to the final imaged product. A number of patents have been directed to water-resistant protective coatings that can be applied to a photographic element prior to development. For example, U.S. Pat. No. 2,706,686 describes the formation of a lacquer finish for photographic emulsions, with the aim of providing water- and fingerprint-resistance by coating the light-sensitive layer, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing. The overcoat as described is coated as a suspension in an organic solvent, and thus is not desirable for large-scale application. More recently, U.S. Pat. No. 5,853,926 to Bohan et al. discloses a protective coating for a photographic element, involving the application of an aqueous coating comprising polymer particles and a soft polymer latex binder. This coating allows for appropriate diffusion of photographic processing solutions, and does not require a coating operation after exposure and processing. Again, however, the hydrophobic polymer particles must be fused to form a protective coating that is continuous and water-impermeable.

U.S. Pat. No. 5,856,051 describes the use of hydrophobic particles with gelatin as the binder in an overcoat formulation. This invention demonstrated an aqueous coatable, water-resistant protective overcoat that can be incorporated into the photographic product, and allows for appropriate diffusion of photographic processing solutions. The hydrophobic polymers exemplified in U.S. Pat. No. 5,856,051 include polyethylene have a melting temperature (Tm) of 55 to 200° C. A layer comprised of such polymers is capable of becoming water-resistant by fusing the layer at a temperature higher than the Tm of the polymer, after the sample has been processed to generate the image. The coating solution is aqueous and can be incorporated into the manufacturing coating operation without any equipment modification.

It can be seen that various approaches have been attempted to obtain an imaged imaging element with resistance to water and mechanical damages. However, the aforementioned prior art references are deficient with regard to simultaneously satisfying performance, environmental, convenience and cost requirements or preferences. Also, in recent years, the use by the public of various printing and imaging technologies on a small scale or at home is increasingly more popular. It has become increasingly more desirable to provide protection for the imaged or printed documents against abrasion, transfer cover materials, water or alcohol spills, ink smear, or other image print degradation processes and detrimental effects from the surroundings. It would be desirable to provide protection for an imaged print without needing to modify processing equipment or needing to train the personnel running the processing operation to apply the protective coating.

The objective of the present invention is to provide an imaged imaging element with a protective overcoat while avoiding the problems and limitations of the prior art. It would be especially desirable to obtain a water-resistant protective overcoat for a photographically imaged element without the addition of laminating or fusing steps, without the need for higher temperatures, and without requiring additional equipment to carry out photoprocessing.

SUMMARY OF THE INVENTION

The present invention relates to a protective overcoat for an imaged photographic element that provides water resistance, fingerprint resistance, and the like. This protective overcoat is made from an overcoat composition comprising epoxy-containing particles comprising at least 50%, by dry weight of the particle, of a solid epoxy compound or resin and which particles having a glass transition temperature of greater than 20° C. and a mean particle size of not more than 500 nm (0.5 microns). The overcoat composition further comprises, in the epoxy-containing particle, a polymer having acid groups. The overcoat composition also comprises a binder material for the epoxy-containing particles, which material comprises a hydrophilic material that is substantially soluble in the developing solution, and a hydrophobically modified associative thickener. The photographic element comprises a support, at least one silver-halide emulsion layer superposed on the support, and overlying the silver-halide emulsion layer, a processing-solution-permeable protective overcoat composition that is coated onto the imaging element during manufacturing and that does not inhibit photographic processing. The presence of a hydrophilic component that is substantially washed out during processing allows photographic processing to proceed at an acceptable rate. The washing out of the hydrophilic component also facilitates the coalescence of the hydrophobic materials in the final product, further facilitated by elevated temperatures commonly associated with drying during photoprocessing.

In one embodiment of the invention, a photographic (imaging) element comprises an overcoat made from a composition comprising 30 to 95 weight percent, based on the dry laydown of the overcoat, of water-dispersible polymer epoxy-containing particles having an average of between 0.01 to 0.5 micrometers, said water-dispersible polymer being characterized by a $T_g$ (glass transition temperature) of greater than 20° C., and 5 to 70 percent of binder. Other materials, such as surfactants, lubricants, thickeners, may also be present in the overcoat composition.

Another aspect of the invention provides for a method of forming an image in the imaging element described above and converting the overcoat into a water-resistant coating.

DESCRIPTION OF THE PREFERRED EMBODIMENTS

The present invention provides a simple and inexpensive way to improve the water, stain and abrasion resistance of processed photographic elements. In accordance with the invention, the protective overcoat is applied over the photographic element prior to image formation. In particular, a overcoat formulation according to the present invention is applied to the emulsion side of photographic products, particularly photographic prints that may encounter frequent handling and abuse by end users.

By the term "water-resistant" is meant herein that the imaged element does not imbibe water and that water-based stains are prevented or minimized.

By the term "elevated temperature," as used in this application, to dry and/or facilitate coalescence of the water-dispersible polymer, is herein meant a temperature of from 30 to 100° C., preferably 45 to 60° C. In contrast, fusing generally requires simultaneously heat and pressure, typically employing a pressure roller or belt, and drying of the imaged element before fusing. Fusing requires higher temperatures, typically above the boiling point of water, usually above 100° C.

The present invention provides an improved overcoat formulation for the imaging side of an imaging element or material, including photographic prints, which encounter frequent handling and abuse by end users. The preferred overcoat formulation of this invention comprises 30 to 95% by weight (based on the dry laydown of the overcoat) of water-dispersible epoxy-containing particles of 0.01 to 0.5 micrometers in average size, 5 to 70% by weight of a hydrophilic polymer which is substantially uncrosslinked (based on the dry laydown of the overcoat), and 0.1 to 10%, preferably 1 to 10% by weight of a hydrophobically modified associative thickener (based on the dry laydown of the overcoat). The epoxy-containing particles further comprise a polymer having an acid number greater than 30 and less than 250, wherein the acid groups carried by the polymer have been neutralized by a base to a degree of neutralization of 50 to 95%.

The photographic element comprises: (a) a support; (b) at least one silver-halide emulsion layer superposed on a side of said support; and overlying the silver emulsion layer, (c) a processing-solution-permeable (nascently protective) overcoat having a laydown of at least 0.54 g/m$^2$ (50 mg/ft$^2$) made from the above-described overcoat formulation. The overcoat composition also contains a water-soluble, hydrophilic polymer that typically is substantially non-crosslinked to facilitate its washing out during processing and, at least to some extent, to facilitate the coalescence of the water-dispersible epoxy-containing particles. The overcoat composition of the photographic element comprises 30 to 95% by weight of solids, preferably 60 to 90 weight percent, of water-dispersible epoxy-containing polymer particles having an average particle size of less than 500 nm and a $T_g$ of greater than 20° C., preferably from 20° C. to 70° C., and 5 to 70%, by weight of solids, preferably 10 to 40 weight percent, of a water-soluble hydrophilic polymer such that more than 30 weight percent of the water-soluble polymer is washed out during photographic processing; wherein the weight ratio of the water-dispersible epoxy-containing particles to the hydrophilic polymer is from 20:80 to 95:5, preferably from 40:60 to 90:10, more between 50:50 and 80:20, whereby the overcoat forms a water-resistant overcoat after photoprocessing without fusing, namely by maintaining the photographic element at temperature less than 100° C. Preferably, the hydrophilic polymer is non-crosslinked and substantially water-soluble. The composition further comprises a hydrophobically modified associative thickener.

The epoxy-containing particles of the invention have a mean size of less than 5 microns, preferably less than 2 microns, and most preferably less than 0.5 microns, and further comprise a polymer having an acid number greater than 30 and less than 250, wherein the acid groups carried by the polymer have been neutralized by a base to a degree of neutralization of 50 to 95%. The epoxy-containing particles comprises a material, a compound or resin, having a 1,2-epoxy functionality, more particularly, having on average greater than about 1.5 epoxide groups per molecule (on a measured basis). The epoxy material can be saturated or unsaturated, linear or branched, aliphatic, cycloaliphatic, aromatic or heterocyclic, and may bear substituents which do not materially interfere with the reaction with the carboxylic acid. Such substituents can include bromine or fluorine. The epoxy material may be monomeric or polymeric. Suitable epoxy resins include glycidyl ethers prepared by reacting epichlorohydrin with a compound containing at least 1.5 aromatic hydroxyl groups carried out under alkaline reaction conditions. Examples of other epoxy resins suitable for use in the invention include diglycidyl ethers of dihydric compounds, epoxy novolacs (substituted or unsubstituted phenyl-containing epoxy materials) and cycloaliphatic epoxies. Generally, epoxy resins contain a distribution of compounds with a varying number of repeat units.

Preferably, the epoxy material is a resin that is a diglycidyl ether of a dihydric phenol, a diglycidyl ether of a hydrogenated dihydric phenol, an aliphatic glycidyl ether, an epoxy novolac, or a cycloaliphatic epoxy. Diglycidyl ethers of dihydric phenols can be produced, for example, by reacting an epihalohydrin with a dihydric phenol in the presence of an alkali. Examples of suitable dihydric phenols include: 2,2-bis(4-hydroxyphenyl)propane(bisphenol-A); 2,2-bis(4-hydroxy-3-tert-butylphenyl)propane; 1,1-bis(4-hydroxyphenyl)ethane; 1,1-bis(4-hydroxyphenyl)isobutane; bis(2-hydroxy-1-naphthyl)methane; 1,5-dihydroxynaphthalene; 1,1-bis(4-hydroxy-3-alkylphenyl) ethane and the like. Suitable dihydric phenols can also be obtained from the reaction of phenol with aldehydes such as formaldehyde (bisphenol-F). Diglycidyl ethers of dihydric phenols include advancement products of the above diglycidyl ethers of dihydric phenols with phenolic compounds such as bisphenol-A, such as those described in U.S. Pat. Nos. 3,477,990 and 4,734,468. Diglycidyl ethers of hydrogenated dihydric phenols can be produced, for example, by hydrogenation of dihydric phenols followed by glycidation reaction with an epihalohydrin in the presence of a Lewis acid catalyst and subsequent formation of the glycidyl ether by reaction with sodium hydroxide.

Aliphatic glycidyl ethers can be produced, for example, by reacting an epihalohydrin with an aliphatic diol in the presence of a Lewis acid catalyst followed by conversion of the halohydrin intermediate to the glycidyl ether by reaction with sodium hydroxide. Examples of suitable aliphatic glycidyl ethers include for example, diglycidyl ethers of 1,4 butanediol, neopentyl glycol, cyclohexane dimethanol, hexanediol, polypropylene glycol, and like diols and glycols; and triglycidyl ethers of trimethylol ethane and trimethylol propane. Epoxy novolacs can be produced by condensation of formaldehyde and a phenol followed by glycidation by reaction of an epihalohydrin in the presence of an alkali. The phenol can be, for example, phenol, cresol, nonylphenol and t-butylphenol. Cycloaliphatic epoxies can be produced by epoxidizing a cycloalkene-containing compound with greater then one olefinic bond with peracetic acid.

Commercial examples of preferred epoxy resins include, for example, EPON™ resin 1001F, 1002F, 1004F, 1007F, 1009F, 2002, 2003, 2004, 2005, 2012, 2014, 2024, 2042, 3001, 3002 available from Shell Chemical Company, and epoxy cresol novolac resin (poly((o-cresyl glycidyl ether)-co-formaldehyde)) available from Sigma-Aldrich Chemical Co.

The water-dispersible epoxy particles comprise, in addition to the epoxy material, a substantially amorphous, thermoplastic polymer having carboxylic acid groups, which polymer can be characterized by the acid number, which is preferably greater than or equal to 60 and relatively permeable to water at a pH of greater than 7. Preferably, the acid number is less than or equal to 200, more preferably less than or equal to 100.

The carboxylated thermoplastic polymers utilized in this invention are preferably prepared by conventional free radical polymerization techniques from at least one ethylenically unsaturated monomer and at least one ethylenically unsaturated acid monomer. The choice of the unsaturated monomer(s) is dictated by the intended end use of the coating composition and is practically unlimited. A variety of acid monomers can be used. Their selection is dependent on the desired final polymer properties.

This acid monomer can be an ethylenically unsaturated acid, mono-protic or diprotic, anhydride or monoester of a dibasic acid, which is copolymerizable with the other monomer(s) used to prepare the polymer. The most preferred acid monomers are acrylic acid, methacrylic acid, and itaconic acid.

The acid number of the carboxylated thermoplastic polymers is between 30 and 250, preferably between 30 and 200. The acid number is the number of milligrams of potassium hydroxide required to neutralize one gram of the polymer. For purposes of illustration, an acid number of 100 corresponds to the presence in the polymer of either 12.8% acrylic acid, 15.3% of methacrylic acid, 11.5% of itaconic acid, or 10.3% of maleic or fumaric acid.

Ethylenically unsaturated monomers which can be used for preparing the carboxylated thermoplastic polymers of the invention include virtually all monomers capable of undergoing addition polymerization to produce polymers free of ionic charge groups and essentially water-insoluble. Typical useful monomers thus include, for example, methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, 2-hydroxypropyl methacrylate acrylonitrile, methacrylonitrile, vinyl acetate, vinyl propionate, vinylidene chloride, vinyl chloride, styrene, t-butyl styrene, vinyl toluene, butadiene, isoprene, and the like.

The polymerization process is initiated in general with free radical initiators. Free radicals of any sort may be used. Preferred initiators include persulfate, peroxides, azo compounds, and redox initiators. The amount of initiator can vary from 0.01% to 2% by the weight of monomer, but is preferably from 0.03 to 1% by weight thereof. Organic peroxides and organic peresters include, for example, benzoyl peroxide, dichlorobenzoyl peroxide, dicumyl peroxide, di-tert-butyl peroxide, lauroyl peroxide, tert-butyl peracetate, 2,5-dimethyl-2,5-di(tert-butylperoxy)hexine-3,2, 5-dimethyl-2,5-di(tert-butylperoxy)hexane, tert-butyl perbenzoate, tert-butyl perphenyl acetate, tert-butylperisobutylate, tert-butyl per-secoctoate, tert-butyl perpivalate, cumyl perpivalate and tert-butyl perdiethyl acetate, and azo compounds include, for example, azobisisobutylnitrile and dimethyl azoisobutylate.

The epoxy-containing particles of the invention can be prepared by various methods known in the art. For example, they can be prepared by pulverizing and classifying the particle material or by spray drying of a solution containing the particle material, including a epoxy resin, followed by redispersing the resultant particles in water using a dispersant. They can be prepared by a suspension technique that consists of dissolving the particle material, including an epoxy compound in, for example, a water immiscible solvent, dispersing the solution as fine liquid droplets in an aqueous solution, and removing the solvent by evaporation or other suitable techniques. They can be prepared by mechanically grinding the particle material, including an epoxy compound, in water to a desired particle size in the presence of a dispersant, heating the epoxy-containing particles dispersed in water to above their melting points, and cooling the melted particles in water to form a stable dispersion. They can be prepared by the so-called "atmospheric emulsification" and "pressure emulsification" techniques. The atmospheric process can be used to prepare epoxy-containing dispersions for epoxy resins with melting points below the boiling point of water. The process typically consists of melting an epoxy compound and a surfactant together. Optionally a base is added to the melt. Hot water is then slowly added to the epoxy melt at vigorous agitation. Pressure emulsification is generally needed for epoxy resins with a melting point greater than 100° C. It is similar to the atmospheric process except at temperature above the water boiling point. Vessels capable of withstanding high pressure are normally needed for such a method.

Various dispersants and surfactants known in the art can be used as stabilizers. The dispersants can be nonionic, anionic, and cationic, and can be polymeric and are used as high as 20% of the epoxy resin. Because such surfactants are potential of causing other problems, the minimum amount of surfactant should be used. Commercial dispersions of epoxy resins often contain a minor amount of surfactant. If the dispersion of epoxy material coagulates or coalesces, then addition of measured amounts of surfactant to freshly prepared dispersions or to the aqueous phase preparatory to formation of the dispersion can be used to assess the stability of the dispersion. Most preferably, the dispersion will be stable with regards to sedimentation of the epoxy-containing dispersed phase. However, in the context of the subject invention, the term "stable" refers to a dispersion where the epoxy resin particles do not coalesce or coagulate, but remain substantially in distinct particles. If such particles sediment upon storage, they may be easily redispersed by shaking or moderate agitation. If, however, the particles coalesce, they cannot be redispersed without high shear mixing for prolonged periods of time.

A preferred method of making epoxy-containing particles for the coating composition according to the present invention comprises (1) dissolving into a volatile solvent mixture an oil-soluble epoxy-functional compound and a polymer having an acid number greater than 30 and less than 250, preferably greater than 60 and less than 200 more preferably less than 150, and optionally a surfactant, (2) adding to the organic solvent medium in a base to neutralize the acid groups to a degree of neutralization less than 95%, preferably less than 90%, (3) dispersing the resulting organic phase into an aqueous medium optionally containing a surfactant, and (4) removing the volatile solvent mixture. Preferably, the volatile solvent mixture comprises a water immiscible organic solvent as the major component and a water miscible organic solvent as a minor component. Such a process advantageously provides very fine submicron particles having a narrow particle size distribution. The dispersions also have excellent stability during storage.

The protective overcoat preferably comprises, in addition to the water-dispersible epoxy particles described above, at least one water-soluble hydrophilic polymer as a binder. Examples of such water-soluble polymers that may be added include polyvinyl alcohol, cellulose ethers, poly(N-vinyl amides), polyacrylamides, polyesters, poly(ethylene oxide), dextrans, starch, uncrosslinked gelatin, whey, albumin, poly (acrylic acid), poly(ethyl oxazolines), alginates, gums, poly (methacrylic acid), poly(oxymethylene), poly (ethyleneimine), poly(ethylene glycol methacrylate), poly (hydroxy-ethyl methacrylate), poly(vinyl methyl ether), poly(styrene sulfonic acid), poly(ethylene sulfonic acid), poly(vinyl phosphoric acid) and poly(maleic acid) and the like. Such materials are included in "Handbook of Water-Soluble Gums and Resins" by Robert I. Davidson (McGraw-Hill Book Company, 1980) or "Organic Colloids" by Bruno Jirgensons (Elsvier Publishing Company, 1958). In a preferred embodiment, the polymer is polyvinyl alcohol, which polymer has been found to yield coatings that are relatively uniform and to enhance the diffusion rate of the developer into the underlying emulsions, in the case of photographic elements.

The preferred hydrophilic polymer is polyvinyl alcohol. The term "polyvinyl alcohol" referred to herein means a polymer having a monomer unit of vinyl alcohol as a main component. Polyvinyl alcohol is typically prepared by substantial hydrolysis of polyvinyl acetate. Such a "polyvinyl alcohol" includes, for example, a polymer obtained by hydrolyzing (saponifying) the acetate ester portion of a vinyl acetate polymer (exactly, a polymer in which a copolymer of vinyl alcohol and vinyl acetate is formed), and polymers obtained by saponifying a trifluorovinylacetate polymer, a vinyl formate polymer, a vinyl pivalate polymer, a tert-butylvinylether polymer, a trimethylsilylvinylether polymer, and the like (the details of "polyvinyl alcohol" can be referred to, for example, "World of PVA", Edited by the Poval Society and Published by Kobunshi Kankoukai, Japan, 1992 and "Poval", Edited by Nagano et al. and Published by Kobunshi Kankoukai, Japan, 1981). The degree of hydrolysis (or saponification) in the polyvinyl alcohol is preferably at least about 70% or more, more preferably at least about 80%. Percent hydrolysis refers to mole percent. For example, a degree of hydrolysis of 90% refers to polymers in which 90 mol % of all copolymerized monomer units of the polymer are vinyl alcohol units. The remainder of all monomer units consists of monomer units such as ethylene, vinyl acetate, vinyl trifluoroacetate and other comonomer units which are known for such copolymers. Most preferably, the polyvinyl alcohol has a weight average molecular weight (MW) of less than 150,000, preferably less than 100,000, and a degree of hydrolysis greater than 70%. If the MW is greater than 100,000, the degree of hydrolysis is preferably less than 95%. Preferably, the degree of hydrolysis is 85 to 90% for a polyvinyl alcohol having a weight average MW of 25,000 to 75,000. These preferred limitations may provide improved manufacturability and processibility. The polyvinyl alcohol is selected to make the coating wettable, readily processable, and in a substantial amount, to readily, not sluggishly, come out of the coating during processing, thereby yielding the final water-resistant product. The optimal amount of polyvinyl alcohol depends on the amount of dry coverage of water-dispersible polymer. In one preferred embodiment of the invention, the polyvinyl alcohol is present in the overcoat in the amount between 1 and 60 weight percent of the water-dispersible polymer, preferably between 5 and 50 weight percent of the water-dispersible polymer, most preferably between 10 and 45 weight percent of the water-dispersible polymer.

Without wishing to be bound by theory, it is believed that the water-soluble polymer and water-dispersible polymer form a biphasic mixture, which allows the formation of a water-resistant overcoat that does not require fusing, merely elevated temperatures preferably up to about 60° C. It is believed that fusing is not required for several reasons: (a) the substantial absence of cross-linked gelatin and other such crosslinked polymers, and (b) the selection of a water-dispersible polymer that is believed to form a biphasic system with the hydrophilic water-soluble polymer, but which after processing forms a water-resistant overcoat. The optimal amount of the water-soluble polymer may depend on the amount of dry coverage of water-dispersible epoxy particles.

For the coating composition, it has long been known that rheological additives, which are added at only a relatively small weight percentage to aqueous coating systems, can modify the coating rheology to satisfy various coating application requirements. Aqueous systems so modified have included latex paints, protective coatings, paper coatings, household detergents, cosmetics and personal care items, adhesives and sealants, inks, drilling fluids, and the like.

Rheological additives are thixotropes which impart a three dimensional network to liquid systems as expressed by increased viscosity at low shear rates. When the system is sheared at high shear rates, this network is broken down, resulting in a decrease in viscosity; the network recovers when the external force is removed. Rheological additives are added at about 0.01% to about 10% (depending on the thickener, the characteristics of the system to be thickened and the desired rheological profile) based on the total weight of the system to be thickened. Often the terms thixotrope, thickener, and rheological additive are used interchangeably.

Many rheological additives for aqueous based systems are available: natural, modified natural and synthetic. Natural rheological additives include guar gum, pectin, casein, carrageanan, xanthan gum and alginates. Modified additives include modified celluloses, most particularly methyl cellulose, hydroxyethyl cellulose, hydroxypropyl cellulose, and carboxymethyl cellulose.

It was discovered by the present inventors unexpectedly that the use of the class of thickeners known as associative thickeners, in the overcoat coating compositions of the invention, improves the overcoat water and stain resistances. In comparison, certain other classes of thickeners can have a negative impact on the overcoat water and stain resistance after photographic processing.

Associative thickeners (polymers), according to the definition thereof which is given in *the Encyclopedia of Polymer Science and Engineering,* 2nd edition, 17, 772–779, are water-soluble polymers containing nonpolar groups which assemble into aggregates in polar media. They consist of a backbone comprising predominantly units of a hydrophilic nature and a minority of hydrophobic sequences. When such structures are placed in aqueous solution, their hydrophobic poles undergo association, in order to limit the interactions between water and hydrophobic sequences. The formation of such physical crosslinking nodes can result in the creation of a real network. The physical gel thus formed considerably increases the viscosity of the water. In the case of an aqueous composition comprising polymer particles, associative polymers also act by creating various bonds between themselves and polymer particles.

The known associative polymers capable of imparting these characteristics include polyurethane associative thickeners and acrylic associative thickeners.

Polyurethane associative agents are polymers of essentially triblock structure, that is to say molecules consisting of three separate portions, the polymerized hydrophilic central portion and two hydrophobic ends, identical or otherwise. The central hydrophilic portion consists of a number of polyether, generally polyethylene oxide, chains. The end portions consist of hydrophobic groups such as, for example, alkyl, aryl or alkylaryl groups. Polyurethane associative polymers are obtained by condensation chemistry. Such agents are described in many patents, as, for example, in patents U.S. Pat. Nos. 3,770,684, 4,079,028 and 4,155,892. Such associative thickeners are commercially available from, for example, Condea Servo BV® as SER-AD FX® 1010, 1050, 1070, and 1100, and Rohm and Hass Company as Accusol®880 and 882.

Acrylic associative agents have a different structure, that of a hydrophilic chain along which pendent hydrophobic units are distributed randomly. They are obtained by copolymerization of a functional monomer of the ethylenic carboxylic acids type, optionally esters of these acids and/or other monomers carrying hydrophilic groups, and of ethylenic monomers carrying a hydrophobic side chain, for example a polyether chain like a polyethylene oxide, comprising a hydrocarbon hydrophobic end radical. Acrylic associative polymers are thus encountered in which the functional monomer is a surfactant alcohol acrylate or methacrylate (patents EP 0,013,836 and U.S. Pat. No. 4,384,096), an oxyethylenated ester of crotonic acid (U.S. Pat. No. 4,569,965), a half-ester of maleic anhydride (patent EP 0,248,621) or a surfactant ether of allyl alcohol (patent EP 0,216,479) or else the result of the condensation of a surfactant alcohol and of an isocyanate containing ethylenic unsaturation (patents U.S. Pat. Nos. 4,514,552, 4,600,761 and EP 0,350,414). All these acrylic associative polymers are obtained by radical polymerization. Such associative thickeners are commercially available from, for example, Union Carbide Corporation as TR® 115, 116, and 117. The preferred associative thickeners for the practice of the invention are the polyurethane associative thickeners.

The protective overcoat should be clear, i.e., transparent, and is preferably colorless. But it is specifically contemplated that the polymer overcoat can have some color for the purposes of color correction, or for special effects, so long as it does not detrimentally affect the formation or viewing of the image through the overcoat. Thus, there can be incorporated into the polymer a dye that will impart color or tint. In addition, additives can be incorporated into the polymer that will give the overcoat various desired properties. For example, a UV absorber may be incorporated into the polymer to make the overcoat UV absorptive, thus protecting the image from UV induced fading. Other compounds may be added to the coating composition, depending on the functions of the particular layer, including surfactants, emulsifiers, coating aids, lubricants, matte particles, crosslinking agents, antifoggants, inorganic fillers such as conductive and nonconductive metal oxide particles, pigments, magnetic particles, biocide, and the like. The coating composition may also include a small amount of organic solvent, preferably the concentration of organic solvent is less than 1 percent by weight of the total coating composition. The invention does not preclude coating the desired polymeric material from a volatile organic solution or from a melt of the polymer.

Examples of surfactants as coating aids include any surface-active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly (glycidol) available from Olin Matheson Corporation or sodium octylphenoxypoly(ethyleneoxide)sulfate, organic sulfates or sulfonates, such as sodium dodecyl sulfate, sodium dodecyl sulfonate, sodium bis(2-ethylhexyl) sulfosuccinate (Aerosol® OT, commercially available from American Cyanamide, Wayne, N.J.), and alkylcarboxylate salts such as sodium decanoate.

The surface characteristics of the overcoat are in large part dependent upon the physical characteristics of the polymers which form the continuous phase and the presence or absence of solid, nonfusible particles. However, the surface characteristics of the overcoat also can be modified by the conditions under which the surface is optionally fused. For example, in contact fusing, the surface characteristics of the fusing element that is used to fuse the polymers to form the continuous overcoat layer can be selected to impart a desired degree of smoothness, texture or pattern to the surface of the element. Thus, a highly smooth fusing element will give a glossy surface to the imaged element, a textured fusing element will give a matte or otherwise textured surface to the element, a patterned fusing element will apply a pattern to the surface of the element, etc.

Matte particles well known in the art may also be used in the coating composition of the invention, such matting agents have been described in *Research Disclosure* No. 308119, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include hydroxyl, carboxyl, carbodiimide, epoxide, aziridine, vinyl sulfone, sulfinic acid, active methylene, amino, amide, allyl, and the like.

In order to reduce the sliding friction of the photographic elements in accordance with this invention, the overcoat composition may contain fluorinated or siloxane-based components and/or the coating composition may also include lubricants or combinations of lubricants. Typical lubricants include (1) silicone based materials disclosed, for example, in U.S. Pat. Nos. 3,489,567, 3,080,317, 3,042,522, 4,004, 927, and 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964, in British Patent Nos. 1,263,722; 1,198,387; 1,430,997; 1,466,304; 1,320,757; 1,320,565; and 1,320,756; and in German Patent Nos. 1,284,295 and 1,284,294; (3) liquid paraffin and paraffin or wax like materials such as carnauba wax, natural and synthetic waxes, petroleum waxes, mineral waxes, silicone-wax copolymers and the like; (4) perfluoro- or fluoro- or fluorochloro-containing materials, which include poly(tetrafluoroethylene), poly (trifluorochloroethylene), poly(vinylidene fluoride, poly (trifluorochloroethylene-co-vinyl chloride), poly(meth) acrylates or poly(meth)acrylamides containing perfluoroalkyl side groups, and the like. Lubricants useful in the present invention are described in further detail in *Research Disclosure* No.308119, published December 1989, page 1006.

The imaging elements of this invention can be of many different types depending on the particular use for which they are intended. Details with respect to the composition and function of a wide variety of different imaging elements are provided in U.S. Pat. No. 5,300,676 and references described therein. Such elements include, for example, photographic, electrophotographic, electrostatographic, photothermographic, migration, electrothermographic, dielectric recording, thermal-dye-transfer, and ink jet recording imaging elements. Layers of imaging elements other than the image-forming layer are commonly referred to auxiliary layers. There are many different types of auxiliary layers such as, for example, subbing layers, backing layers, interlayers, overcoat layers, receiving layers, stripping layers, antistatic layers, transparent magnetic layers, and the like.

Support materials for an imaging element often employ auxiliary layers comprising glassy, hydrophobic polymers such as polyacrylates, polymethacrylates, polystyrenes, or cellulose esters, for example. One typical application for such an auxiliary layer is as a backing layer to provide resistance to abrasion, scratching, blocking, and ferrotyping. Such backing layers may be applied directly onto the support material, applied onto a priming or "subbing" layer, or applied as an overcoat for an underlying layer such as an antistatic layer, transparent magnetic layer, or the like. For example, U.S. Pat. No. 4,203,769 describes a vanadium pentoxide-containing antistatic layer that is overcoated with a cellulosic layer applied from an organic solvent. U.S. Pat. Nos. 4,612,279 and 4,735,976 describe organic solvent-applied layers comprising a blend of cellulose nitrate and a copolymer containing acrylic acid or methacrylic acid that serve as overcoats for antistatic layers.

The thickness of the support is not critical. Support thicknesses of 2 to 15 mils (0.002 to 0.015 inches) can be used. Biaxially oriented support laminates can be used with the present invention. These supports are disclosed in commonly owned U.S. Pat. Nos. 5,853,965, 5,866,282, 5,874, 205, 5,888,643, 5,888,681, 5,888,683, and 5,888,714, incorporated in their entirety by reference herein. These supports include a paper base and a biaxially oriented polyolefin sheet, typically polypropylene, laminated to one or both sides of the paper base. At least one photosensitive silver halide layer is applied to the biaxially oriented polyolefin sheet.

The coating composition of the invention can be applied by any of a number of well known techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in *Research Disclosure* No. 308119, Published December 1989, pages 1007 to 1008. Preferably, a commercial embodiment involve simultaneous co-extrusion. The laydown of the overcoat will depend on its field of application. For a photographic element, the laydown of the polyurethane-containing copolymer is suitably at least 0.54 $g/m^2$ (50 $mg/ft^2$), preferably 1.08 to 5.38 $g/m^2$ (100 to 500 $mg/ft^2$), most preferably 1.61 to 3.23 $g/m^2$(150 to 300 $mg/ft^2$). After applying the coating composition to the imaging element, it may be dried over a suitable period of time, for example 2 to 4 minutes.

Photographic elements can contain conductive layers incorporated into multilayer photographic elements in any of various configurations depending upon the requirements of the specific photographic element. Preferably, the conductive layer is present as a subbing or tie layer underlying a magnetic recording layer on the side of the support opposite the photographic layer(s). However, conductive layers can be overcoated with layers other than a transparent magnetic recording layer (e.g., abrasion-resistant backing layer, curl control layer, pelloid, etc.) in order to minimize the increase in the resistivity of the conductive layer after overcoating. Further, additional conductive layers also can be provided on the same side of the support as the photographic layer(s) or on both sides of the support. An optional conductive subbing layer can be applied either underlying or overlying a gelatin subbing layer containing an antihalation dye or pigment. Alternatively, both antihalation and antistatic functions can be combined in a single layer containing conductive particles, antihalation dye, and a binder. Such a hybrid layer is typically coated on the same side of the support as the sensitized emulsion layer. Additional optional layers can be present as well. An additional conductive layer can be used as an outermost layer of a photographic element, for example, as a protective layer overlying an image-forming layer. When a conductive layer is applied over a sensitized emulsion layer, it is not necessary to apply any intermediate layers such as barrier or adhesion-promoting layers between the conductive overcoat layer and the photographic layer(s), although they can optionally be present. Other addenda, such as polymer lattices to improve dimensional stability, hardeners or cross-linking agents, surfactants, matting agents, lubricants, and various other well-known additives can be present in any or all of the above mentioned layers.

Photographic elements of this invention can differ widely in structure and composition. For example, the photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure*, Item 36230 (June 1994). Photographic elements can be either simple black-and-white or monochrome elements or multilayer and/or multicolor elements adapted for use in a negative-positive process or a reversal process. Generally, the photographic element is prepared by coating one side of the film support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure*, Vol. 176, Item 17643 (December 1978).

Photographic elements protected in accordance with this invention may be derived from silver-halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion-picture prints or they can be imaged elements that are viewed by reflection, such a paper prints. Because of the amount of handling that can occur with paper prints and motion picture prints, they are the preferred imaged photographic elements for use in this invention.

While a primary purpose of applying an overcoat to imaged elements in accordance with this invention is to protect the element from physical damage, application of the overcoat may also protect the image from fading or yellowing. This is particularly true with elements that contain images that are susceptible to fading or yellowing due to the action of oxygen. For example, the fading of dyes derived from pyrazolone and pyrazoloazole couplers is believed to be caused, at least in part, by the presence of oxygen, so that the application of an overcoat which acts as a barrier to the passage of oxygen into the element will reduce such fading.

Photographic elements in which the images to be protected are formed can have the structures and components shown in Research Disclosures 37038 and 38957. Other structures which are useful in this invention are disclosed in commonly owned U.S. Ser. No. 09/299,395, filed Apr. 26, 1999 and U.S. Ser. No. 09/299,548, filed Apr. 26, 1999, incorporated in their entirety by reference. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

The photographic element can contain additional layers, such as filter layers, interlayers, overcoat layers, subbing layers, and the like. All of these can be coated on a support that can be transparent (for example, a film support) or reflective (for example, a paper support). Photographic elements protected in accordance with the present invention may also include a magnetic recording material as described in *Research Disclosure*, Item 34390, November 1992, or a transparent magnetic recording layer such as a layer containing magnetic particles on the underside of a transparent support as described in U.S. Pat. Nos. 4,279,945 and 4,302,523.

Suitable silver-halide emulsions and their preparation, as well as methods of chemical and spectral sensitization, are described in Sections I through V of Research Disclosures 37038 and 38957. Others are described in U.S. Ser. No. 09/299,395, filed Apr. 26, 1999 and U.S. Ser. No. 09/299,548, filed Apr. 26, 1999, which are incorporated in their entirety by reference herein. Color materials and development modifiers are described in Sections V through XX of Research Disclosures 37038 and 38957. Vehicles are described in Section II of Research Disclosures 37038 and 38957, and various additives such as brighteners, antifoggants, stabilizers, light absorbing and scattering materials, hardeners, coating aids, plasticizers, lubricants and matting agents are described in Sections VI through X and XI through XIV of Research Disclosures 37038 and 38957. Processing methods and agents are described in Sections XIX and XX of Research Disclosures 37038 and 38957, and methods of exposure are described in Section XVI of Research Disclosures 37038 and 38957.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process,* 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

In one embodiment of a method of using a composition according to the present invention, a photographic element may be provided with a processing-solution-permeable overcoat having the above described composition overlying the silver halide emulsion layer superposed on a support. The photographic element is developed in an alkaline developer solution having a pH greater than 7, preferably greater than 8, more preferably greater than 9. This allows the developer to penetrate the protective coating. After the pH is reduced, for example in a bleach fix solution, the protective overcoat becomes relatively water resistant. The addition of a hydrophilic polymer such as polyvinyl alcohol, according to one embodiment of the present invention, facilitates this method. It has been found the polyvinyl alcohol can provide improved wettability of the surface during processing and, at the same time, allows more of the polyvinyl alcohol to be washed out during the processing, so that the final product is more water resistant. Suitably at least 30%, preferably greater than 50%, more preferably greater than 75% of the original amount of hydrophilic polymer in the overcoat is washed out during processing of the exposed photographic element, such that the final product is depleted in hydrophilic polymer and hence relatively more water resistant. Although the processing-solution-permeable overcoat does not require fusing, optional fusing may improve the water resistance further The present invention is illustrated by the following examples. Unless otherwise indicated, the molecular weights herein are weight average molecular weights, as determined by size exclusion chromatography described below.

EXAMPLES

Preparation of Epoxy Particles of the Invention

P1 (Epoxy Dispersion)

An organic phase was made by dissolving 270 grams of Carboset® 525 acrylic copolymer (BF Goodrich Specialty Chemicals) followed by 630 grams of Epon® 1001F epoxy resin (Shell Chemical Co.), in 2100 grams of a 90:10 solvent mixture of ethyl acetate and acetone. 1000 grams of the organic phase was then added with 40 grams of isopropanol and neutralized with 19.5 grams of triethyl amine. An aqueous phase was prepared by mixing 220 grams of a 10% Alkanol® XC surfactant solution with 37 grams of a 30% poly(vinyl alcohol) solution (Aldrich, Cat. No. 36,062-7) and 1943 grams of water. The neutralized organic and aqueous phases were mixed and passed through a microfluidizer for 5 passes at 3500 psi. Volatile solvents were stripped from the dispersed mixture by purging the space above the dispersion with nitrogen at 35° C. or by removing with a rotary evaporator. The resulting dispersion was approximately 14% solids, and had a particle size of 250 nm and a Tg of 44° C.

P2 (Epoxy Dispersion)

This dispersion was made in a similar fashion to P1 but used 15 grams of Carboset® 526 and 135 grams of an epoxy resin sold by Aldrich Chemical Company under Catalog Number 40,804-2. The resulting dispersion had a particle size of 250 nm and a Tg of 38° C.

P3 (Epoxy Dispersion)

An organic phase was made by dissolving 280 grams of Carboset® 525 acrylic coplymer (BF Goodrich Specialty Chemicals) followed by 655 grams of Epon® 1001F epoxy resin (Shell Chemical Co.), in 2245 grams of a 90:10 solvent mixture of ethyl acetate and acetone. The organic phase was then added with 788 grams of isopropanol and neutralized with 100 grams of 20% KOH solution. An aqueous phase was prepared by mixing 785 grams of a 10% Alkanol® XC surfactant solution with 103 grams of a 30% poly(vinyl alcohol) solution (Aldrich, Cat. No. 36,062-7) and 5339 grams of water. The neutralized organic and aqueous phases were mixed and passed through a microfluidizer for 5 passes at 3500 psi. Volatile solvents were stripped from the dispersed mixture by purging the space above the dispersion with nitrogen at 65° C. The resulting dispersion was approximately 15% solids, and had a particle size of 175 nm and a Tg of 44° C.

P4 (Epoxy Disperson)

This dispersion was made in a similar fashion to P1 but used 15 grams of Carboset® 525 and 135 grams of Epon® 1001F epoxy resin (Shell Chemical Co.). The resulting dispersion had a particle size of less than 250 nm and a Tg of 45° C.

Additional Materials (1) Airvol® 203 poly(vinyl alcohol) (PVA) was obtained from Air Products which was 87 to 89% hydrolyzed (by hydrolyzed is meant that the acetate groups in the monomeric units are converted to hydroxy groups) and had a number-average molecular weight of 12,000 and a weight-average molecular weight of 35,000.

(2) Accusol® 882, a water-soluble associative thickener used as a viscosifying agent, commercially available from Rohm& Haas (Philadelphia, Pa.).

(3) Natrosol® Plus 330, a hydroxyethyl cellulose thickener sold by Hercules Incorporated Photographic Sample Preparation Samples was prepared by coating in sequence blue-light sensitive layer, interlayer, green-light sensitive layer, UV layer, red-light sensitive layer, UV layer and overcoat on photographic paper support. The components in each individual layer are described below.

Blue Sensitive Emulsion (Blue EM-1)

A high chloride silver halide emulsion is precipitated by adding approximately equimolar silver nitrate and sodium chloride solutions into a well stirred reactor containing glutaryldiaminophenyldisulfide, gelatin peptizer and thioether ripener. Cesium pentachloronitrosylosmate(II) dopant is added during the silver halide grain formation for most of the precipitation, followed by the addition of potassium hexacyanoruthenate(II), potassium (5-methylthiazole)-pentachloroiridate, a small amount of KI solution, and shelling without any dopant. The resultant emulsion contains cubic shaped grains having edge length of 0.6 $\mu$m. The emulsion is optimally sensitized by the addition of a colloidal suspension of aurous sulfide and heat ramped to 60° C. during which time blue sensitizing dye BSD-4, potassium hexchloroiridate, Lippmann bromide and 1-(3-acetamidophenyl)-5-mercaptotetrazole were added.

Green Sensitive Emulsion (Green EM-1)

A high chloride silver halide emulsion is precipitated by adding approximately equimolar silver nitrate and sodium chloride solutions into a well stirred reactor containing, gelatin peptizer and thioether ripener. Cesium pentachloronitrosylosmate(II) dopant is added during the silver halide grain formation for most of the precipitation, followed by the addition of potassium (5-methylthiazole)-pentachloroiridate. The resultant emulsion contains cubic shaped grains of 0.3 μm in edge length size. The emulsion is optimally sensitized by the addition of glutaryldiaminophenyldisulfide, a colloidal suspension of aurous sulfide and heat ramped to 55° C. during which time potassium hexachloroiridate doped Lippmann bromide, a liquid crystalline suspension of green sensitizing dye GSD-1, and 1-(3-acetamidophenyl)-5-mercaptotetrazole were added.

Red Sensitive Emulsion (Red EM-1)

A high chloride silver halide emulsion is precipitated by adding approximately equimolar silver nitrate and sodium chloride solutions into a well stirred reactor containing gelatin peptizer and thioether ripener. During the silver halide grain formation, potassium hexacyanoruthenate(II) and potassium (5-methylthiazole)-pentachloroiridate are added. The resultant emulsion contains cubic shaped grains of 0.4 μm in edgelength size. The emulsion is optimally sensitized by the addition of glutaryldiaminophenyldisulfide, sodium thiosulfate, tripotassium bis{2-[3-(2-sulfobenzamido)phenyl]-mercaptotetrazole} gold(I) and heat ramped to 64° C. during which time 1-(3-acetamidophenyl)-5-mercaptotetrazole, potassium hexachloroiridate, and potassium bromide are added. The emulsion is then cooled to 40° C., pH adjusted to 6.0 and red sensitizing dye RSD-1 is added.

Coupler dispersions were emulsified by methods well known in the art. The following imaging layers were coated in sequence on polyethylene-laminated photographic paper.

| Layer | Item | Laydown (mg/ft$^2$) |
|---|---|---|
| Layer 1 | Blue Sensitive Layer | |
| | Gelatin | 122.0 |
| | Blue sensitive silver (Blue EM-1) | 22.29 |
| | Y-4 | 38.49 |
| | ST-23 | 44.98 |
| | Tributyl Citrate | 20.24 |
| | ST-24 | 11.25 |
| | ST-16 | 0.883 |
| | Sodium Phenylmercaptotetrazole | 0.009 |
| | Piperidino hexose reductone | 0.2229 |
| | 5-chloro-2-methyl-4-isothiazolin-3-one/2-methyl-4-isothiazolin-3-one(3/1) | 0.019 |
| | SF-1 | 3.40 |
| | Potassium chloride | 1.895 |
| | Dye-1 | 1.375 |
| Layer 2 | Interlayer | |
| | Gelatin | 69.97 |
| | ST-4 | 9.996 |
| | Diundecyl phthalate | 18.29 |
| | 5-chloro-2-methyl-4-isothiazolin-3-one/2-methyl-4-isothiazolin-3-one(3/1) | 0.009 |
| | Catechol disulfonate | 3.001 |
| | SF-1 | 0.753 |
| Layer 3 | Green Sensitive Layer | |
| | Gelatin | 110.96 |
| | Green sensitive silver (Green EM-1) | 9.392 |
| | M-4 | 19.29 |
| | Oleyl Alcohol | 20.20 |
| | Diundecyl phthalate | 10.40 |
| | ST-1 | 3.698 |
| | ST-3 | 26.39 |
| | Dye-2 | 0.678 |
| | 5-chloro-2-methyl-4-isothiazolin-3-one/2-methyl-4-isothiazolin-3-one(3/1) | 0.009 |
| | SF-1 | 2.192 |
| | Potassium chloride | 1.895 |
| | Sodium Phenylmercaptotetrazole | 0.065 |
| Layer 4 | M/C Interlayer | |
| | Gelatin | 69.97 |
| | ST-4 | 9.996 |
| | Diundecyl phthalate | 18.29 |
| | Acrylamide/t-Butylacrylamide sulfonate copolymer | 5.026 |
| | Bis-vinylsulfonylmethane | 12.91 |
| | 3,5-Dinitrobenzoic acid | 0.009 |
| | Citric acid | 0.065 |

-continued

| | | |
|---|---|---|
| | Catechol disulfonate | 3.001 |
| | 5-chloro-2-methyl-4-isothiazolin-3-one/2-methyl-4-isothiazolin-3-one(3/1) | 0.009 |
| Layer 5 | Red Sensitive Layer | |
| | Gelatin | 125.96 |
| | Red Sensitive silver (Red EM-1) | 17.49 |
| | IC-35 | 21.59 |
| | IC-36 | 2.397 |
| | UV-1 | 32.99 |
| | Dibutyl sebacate | 40.49 |
| | Tris(2-ethylhexyl)phosphate | 13.50 |
| | Dye-3 | 2.127 |
| | Potassium p-toluenethiosulfonate | 0.242 |
| | 5-chloro-2-methyl-4-isothiazolin-3-one/2-methyl-4-isothiazolin-3-one(3/1) | 0.009 |
| | Sodium Phenylmercaptotetrazole | 0.046 |
| | SF-1 | 4.868 |
| Layer 6 | UV Overcoat | |
| | Gelatin | 76.47 |
| | UV-2 | 3.298 |
| | UV-1 | 18.896 |
| | ST-4 | 6.085 |
| | SF-1 | 1.162 |
| | Tris(2-ethylhexyl)phosphate | 7.404 |
| | 5-chloro-2-methyl-4-isothiazolin-3-one/2-methyl-4-isothiazolin-3-one(3/1) | 0.009 |
| Layer 7 | SOC | |
| | Gelatin | 60.0 |
| | SF-1 | 1.0 |
| | SF-2 | 0.39 |

BSD-4

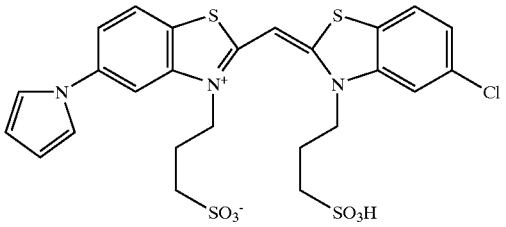

GSD-1

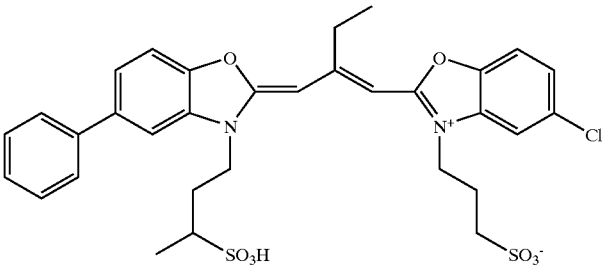

RSD-1

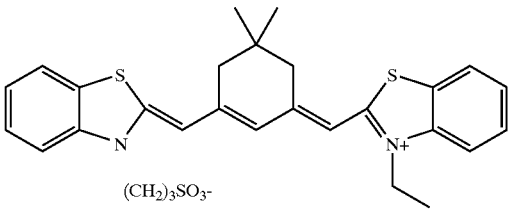

-continued
Y-4
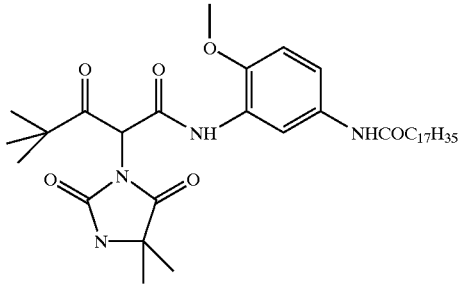
M-4
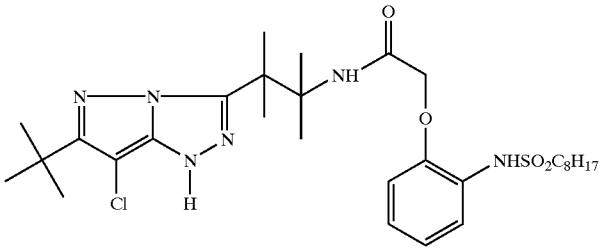
IC-35
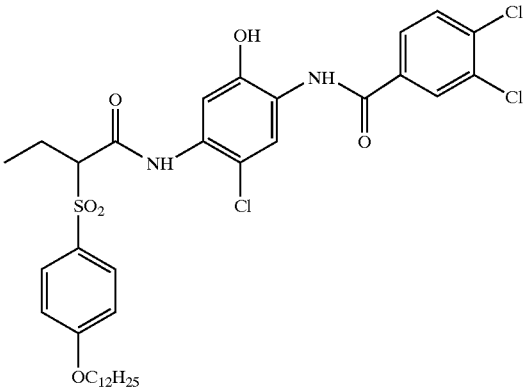
IC-36
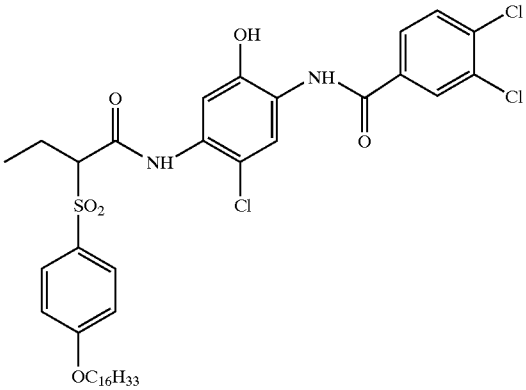
Dye-1
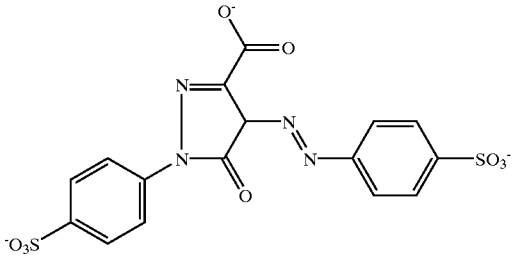

-continued
Dye-2
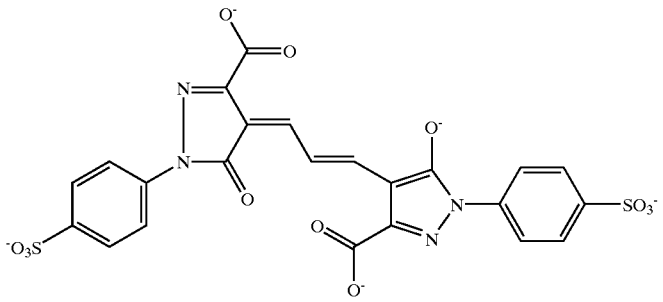
Dye-3
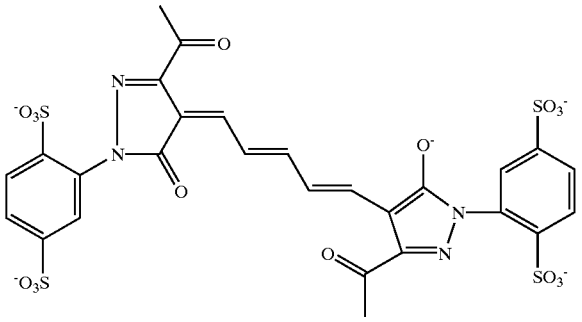
ST-1
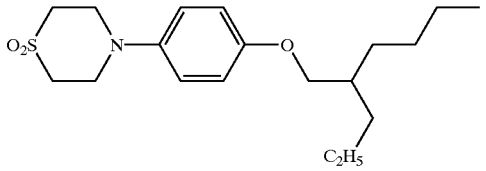
ST-3
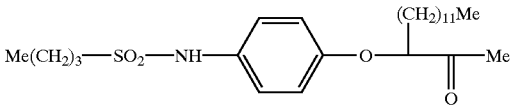
ST-4
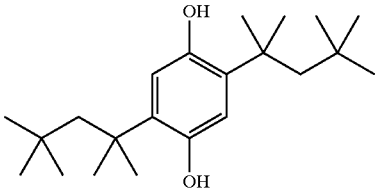
ST-16
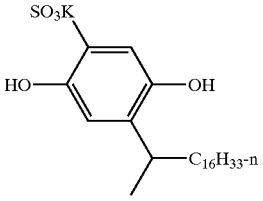
ST-23
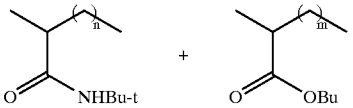
n:m = 1:1; MW = 75,000–100,000

-continued

ST-24

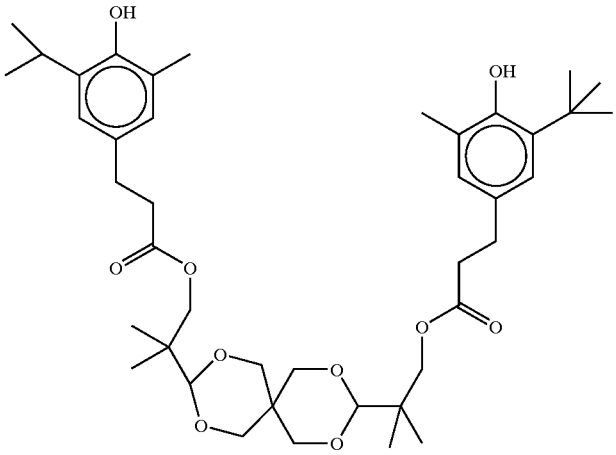

UV-1

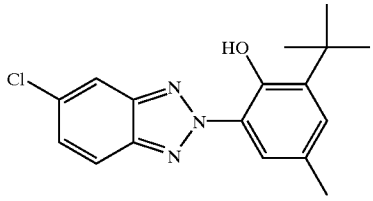

UV-2

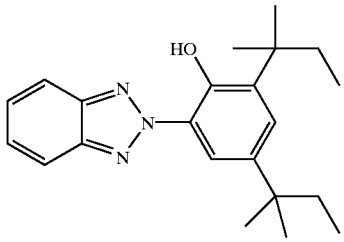

SF-1

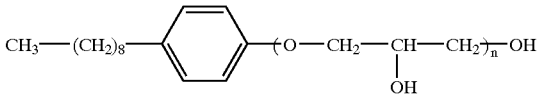

SF-2 $CF_3.(CF_2)_7.SO_3Na$

Test for Water Resistance

Aqueous solutions of Ponceau Red dye are known to stain gelatin through ionic interaction and therefore are used to test water resistance of the overcoats. Ponceau Red dye solution was prepared by dissolving 1 gram dye in 1000 grams mixture of acetic acid and water (5 parts: 95 parts). Samples, without being exposed to light, were processed through the Kodak RA4 process to obtain white Dmin samples. The water resistance test was done by placing a drop of the dye solution on the sample for 10 minutes followed by a 30-second water rinse to removed excess dye solution on the coating surface. Each sample was then air dried, and status A reflectance density on the spotted area was recorded. Assuming that the optical density of a Dmin check image with no protective overcoat corresponds to 0% water resistance and that an optical density of 0 corresponds to 100% water resistance, the percent water resistance for a sample is calculated using the following equation.

Percent water resistance=100[1-(status A density of sample/status A density of check)]

Example

Color photographic paper samples were prepared by replacing the standard gelatin-containing overcoat with the coating compositions of the invention comprising an epoxy containing polymer particle.

TABLE 1

| ID | Overcoat Composition (in mg/sq.ft.) | Note | % Water resistance after standard processing |
|---|---|---|---|
| Example 1 | 60 gelatin | Comparison | 0 |
| Example 2 | 140 P1<br>21 gelatin | Comparison | 0 |
| Example 3 | 140 P4<br>25 PVA | Comparison | 80 |
| Example 4 | 140 P4<br>25 PVA<br>15 Accusol ®<br>882 thickener | Invention | 99 |

TABLE 1-continued

| ID | Overcoat Composition (in mg/sq.ft.) | Note | % Water resistance after standard processing |
|---|---|---|---|
| Example 5 | 140 P1<br>55 PVA<br>15 Accusol ®<br>882 thickener | Invention | 99 |
| Example 6 | 140 P2<br>25 PVA | Comparison | 80 |
| Example 7 | 140 P2<br>25 PVA<br>10 Accusol ®<br>882 thickener | Invention | 85 |
| Example 8 | 140 P3<br>55 PVA<br>13 Accusol ®<br>882 thickener | Invention | 99 |
| Example 9 | 140 P3<br>55 PVA<br>5.25 Natrosol ® Plus 330 thickener | Comparison | 0 |
| Example 10 | 160 P3<br>55 PVA<br>15 Accusol ®<br>882 thickener | Invention | 99 |
| Example 11 | 140 P1<br>35 PVA<br>13 Accusol ®<br>882 thickener | Invention | 99 |
| Example 12 | 140 P1<br>35 PVA<br>17 Accusol ®<br>882 thickener | Invention | 99 |

It is evident from Table 1 that use of the inventive overcoat greatly improves the water resistance relative to a conventional gelatin overcoat and that the use of a water-soluble hydrophilic binder such as PVA is advantaged over the use of crosslinked gelatin as a binder for the water-dispersible particles. Furthermore, it is evident that the associative thickener unexpectedly improves the water resistance of the overcoat. In comparison to an associative thickener according to the present invention, the Natrosol® thickener also achieves good viscosity, but interferes with purpose of the overcoat, apparently interfering with coalescence of the particles to form a water-resistant layer.

The invention has been described in detail with particular reference to certain preferred embodiments thereof, but it will be understood that variations and modifications can be effected within the spirit and scope of the invention.

What is claimed is:

1. A photographic element having a nascent water-resistant protective overcoat thereon, comprising the following:

(a) a support;

(b) at least one silver-halide emulsion layer superposed on a side of said support; and (c) overlying the silver emulsion layer, a processing-solution-permeable overcoat having a laydown of at least 0.54 g/m$^2$ (50 mg/ft$^2$) of a coating composition comprising (i) water-dispersible latex particles having an average particle size of from 0.01 to 0.5 microns and a Tg of greater than 20° C., which particles comprise an epoxy material, having on average at least 1.5 epoxy groups per molecule, and a thermoplastic acid polymer having an acid number between 30 and 250, wherein the acid groups carried by the polymer have been neutralized by a base to a degree of neutralization of 50 to 95%, and (ii) a water-soluble hydrophilic polymer, and (iii) a hydrophobically modified associative thickener.

2. The photographic element of claim 1 wherein the epoxy material is a diglycidyl ether of a dihydric phenol.

3. The imaging element of claim 1 wherein the thickener is selected from the group consisting of polyurethane associative thickeners and acrylic associative thickeners.

4. The imaging element of claim 1 wherein the coating composition further comprises a surfactant.

5. The imaging element of claim 1 wherein the base is a tertiary amine compound.

6. The photographic element of claim 1 wherein the thermoplastic polymer comprises an acid monomer selected from the group consisting of an ethylenically unsaturated acid and mono-protic, diprotic, anhydride or monoester of a dibasic acid.

7. The photographic element of claim 1 wherein the thermoplastic polymer comprises a monomer selected from the group consisting of acrylic acid, methacrylic acid, and itaconic acid.

8. The photographic element of claim 1 wherein the hydrophilic polymer is selected from the group consisting of polyvinyl alcohol, cellulose ethers, poly(N-vinyl amides), polyacrylamides, polyesters, poly(ethylene oxide), dextrans, starch, uncrosslinked gelatin, whey, albumin, poly(acrylic acid), poly(ethyl oxazolines), alginates, gums, poly (methacrylic acid), poly(oxymethylene), poly (ethyleneimine), poly(ethylene glycol methacrylate), poly (hydroxy-ethyl methacrylate), poly(vinyl methyl ether), poly(styrene sulfonic acid), poly(ethylene sulfonic acid), poly(vinyl phosphoric acid) and poly(maleic acid).

9. The photographic element of claim 1 wherein the weight ratio of the water-dispersible latex particles to the hydrophilic polymer is between 50:50 and 80:20.

10. The photographic element of claim 1 wherein the support comprises polymeric films, paper or glass.

11. The photographic element of claim 1 wherein the coating composition further comprises UV absorbers, surfactants, emulsifiers, coating aids, lubricants, matte particles, rheology modifiers, crosslinking agents, antifoggants, inorganic fillers, pigments, magnetic particles and/or biocides.

12. The photographic element of claim 1 wherein the element is capable of forming an image based on the reaction of a coupler with a developing agent in the presence of silver-halide emulsion.

13. A method of making a photographic print comprising:

(a) providing a photographic element comprising a support, a silver-halide emulsion layer superposed on a side of said support, a processing-solution-permeable coating overlying the silver-halide emulsion layer, said coating having a laydown of at least 0.54 g/m$^2$ (50 mg/ft$^2$) made from a coating composition comprising water-dispersible latex particles having an average particle size of from 0.01 to 0.5 microns and a Tg of greater than 20° C., which particles comprise an epoxy material, having on average at least 1.5 epoxy groups per molecule, and a thermoplastic polymer having an acid number between 30 and 250, wherein the acid groups carried by the polymer have been neutralized by a base to a degree of neutralization of 50 to 95%, a water-soluble hydrophilic polymer, and a hydrophobically modified associative thickener, and (b) developing the photographic element in a developer solution having a pH greater than 7 to obtain the photographic print; and (c) drying the photographic element at an average temperature of not more than 100° C. to render the overcoat water-resistant in the final product.

14. The method of claim 13 wherein said water-soluble hydrophilic polymer is selected from the group consisting of polyvinyl alcohol, cellulose ethers, poly(N-vinyl amides), polyacrylamides, polyesters. poly(ethylene oxide), dextrans, starch, uncrosslinked gelatin, whey, albumin, poly(acrylic acid), poly(ethyl oxazolines), alginates, gums, poly (methaciylic acid), poly(oxymethylene), poly (ethyleneimine), poly(ethylene glycol methacrylate), poly (hydroxy-ethyl methacrylate), poly(vinyl methyl ether), poly(styrene sulfonic acid), poly(ethylene sulfonic acid), poly(vinyl phosphoric acid) and poly(maleic acid), and combinations thereof.

* * * * *